US009246264B2

(12) United States Patent
Daly et al.

(10) Patent No.: US 9,246,264 B2
(45) Date of Patent: Jan. 26, 2016

(54) LOCKOUT FEATURES FOR ELECTRICAL RECEPTACLE ASSEMBLIES

(71) Applicants: Timothy Patrick Daly, Syracuse, NY (US); Adam Scott Hagerty, Whitesboro, NY (US)

(72) Inventors: Timothy Patrick Daly, Syracuse, NY (US); Adam Scott Hagerty, Whitesboro, NY (US)

(73) Assignee: Cooper Technologies Company, Houston, TX (US)

( * ) Notice: Subject to any disclaimer, the term of this patent is extended or adjusted under 35 U.S.C. 154(b) by 186 days.

(21) Appl. No.: 14/080,608

(22) Filed: Nov. 14, 2013

(65) Prior Publication Data

US 2015/0132983 A1 May 14, 2015

(51) Int. Cl.

| | |
|---|---|
| ***H01R 13/625*** | (2006.01) |
| ***H01R 13/46*** | (2006.01) |
| ***H01R 13/52*** | (2006.01) |

(52) U.S. Cl.

CPC ..... *H01R 13/625* (2013.01); *H01R 13/46* (2013.01); *H01R 13/52* (2013.01)

(58) Field of Classification Search

CPC ..... H01R 13/46; H01R 13/52; H01R 33/971; H01R 33/973

USPC ..... 439/302, 332, 660

See application file for complete search history.

(56) References Cited

U.S. PATENT DOCUMENTS

| | | | | |
|---|---|---|---|---|
| 6,783,382 | B2 | 8/2004 | Felps | |
| 7,740,499 | B1 | 6/2010 | Willey et al. | |
| 8,333,605 | B2 | 12/2012 | McQuilken et al. | |
| 8,944,837 | B2 | 2/2015 | Huang | |
| 8,951,051 | B2 | 2/2015 | Natter et al. | |
| 9,093,783 | B2 * | 7/2015 | Grimm | H01R 13/625 |
| 2015/0031235 | A1 * | 1/2015 | Wiesemann | B60L 3/0069 439/488 |
| 2015/0180167 | A1 * | 6/2015 | Haas | H01R 13/64 439/311 |

* cited by examiner

*Primary Examiner* — Khiem Nguyen

(74) *Attorney, Agent, or Firm* — King & Spalding LLP

(57) ABSTRACT

An electrical receptacle assembly having an outer body and a faceplate. The outer body can include at least one driven feature disposed on an outer surface of the outer body. The faceplate can include a number of terminal receivers and at least one driving feature, where the terminal receivers traverse the faceplate and are configured to receive a number of terminals of an electrical plug, and where the at least one driving feature is disposed on a bottom side of the faceplate. The faceplate can rotate between a first position and a second position. The driving feature of the faceplate can couple to the driven feature of the outer body when the faceplate is out of the first position. The faceplate can rotate from the first position to the second position using the electrical plug when the terminals are disposed in the terminal receivers.

19 Claims, 11 Drawing Sheets

LOCKOUT FEATURES FOR ELECTRICAL RECEPTACLE ASSEMBLIES

CROSS-REFERENCE TO RELATED APPLICATIONS

The present application is related to U.S. patent application Ser. No. 14/080,574 titled "Contact Mechanisms For Electrical Receptacle Assemblies," which is being filed concurrently with the U.S. Patent and Trademark Office, and is hereby incorporated by reference in its entirety.

TECHNICAL FIELD

The present disclosure generally relates to electrical receptacles (also called receptacle assemblies) and, particularly, to lockout features for electrical receptacle assemblies.

BACKGROUND

Electrical receptacles are used to distribute electrical power to one or more devices. Electrical receptacles also are used to provide a relatively quick disconnect of a source of power feeding the one or more devices. The electrical receptacle is configured to receive an electrical plug. When the electrical plug is mechanically coupled to the electrical receptacle, power flows through the electrical receptacle.

SUMMARY

In general, in one aspect, the disclosure relates to an electrical receptacle assembly. The electrical receptacle assembly can include an outer body having at least one driven feature disposed on an outer surface of the outer body and a number of pin assemblies disposed within the outer body, where the pin assemblies are configured to receive a number of terminals of an electrical plug. The electrical receptacle assembly can also include a faceplate having a number of terminal receivers and at least one driving feature, where the terminal receivers traverse the faceplate and are configured to receive the terminals of the electrical plug, and where the at least one driving feature is disposed on a surface of the faceplate. The faceplate can be configured to rotate relative to the outer body. The at least one driving feature of the faceplate can couple to the at least one driven feature of the outer body when the faceplate is in a home position and when an inward force is applied by the electrical plug when the terminals of the electrical plug are disposed through the terminal receivers of the faceplate.

In another aspect, the disclosure can generally relate to an electrical receptacle assembly. The electrical receptacle assembly can include an outer body having at least one driven feature disposed on an outer surface of the outer body and a number of pin assemblies disposed within the outer body, where the pin assemblies are configured to receive a number of terminals of an electrical plug. The electrical receptacle assembly can also include a faceplate having a number of terminal receivers and at least one driving feature, where the terminal receivers traverse the faceplate and are configured to receive the terminals of the electrical plug, and where the at least one driving feature is disposed on a surface of the faceplate. The at least one driving feature of the faceplate can couple to at least one ramp of the at least one driven feature of the outer body when the faceplate is out of a home position. The faceplate can be configured to rotate to the home position using the electrical plug when the terminals are disposed in the plurality of terminal receivers.

In another aspect, the disclosure can generally relate to an electrical receptacle assembly. The electrical receptacle assembly can include a faceplate having a number of terminal receivers, at least one locking key receiver, and at least one driving feature, where the terminal receivers traverse the faceplate and are configured to receive a number of terminals of an electrical plug, and where the at least one driving feature is disposed on a surface of the faceplate. The at least one driving feature can be configured to couple to at least one driven feature of an outer body of the electrical receptacle when the faceplate is in a home position and when an inward force is applied by the electrical plug on the faceplate. The faceplate can be in the home position when the at least one locking key receiver receives at least one locking key disposed on a housing of the electrical receptacle assembly.

These and other aspects, objects, features, and embodiments will be apparent from the following description and the appended claims.

BRIEF DESCRIPTION OF THE DRAWINGS

For a more complete understanding of the example embodiments and the advantages thereof, reference is now made to the following description, in conjunction with the accompanying figures briefly described as follows.

Figure 1A:
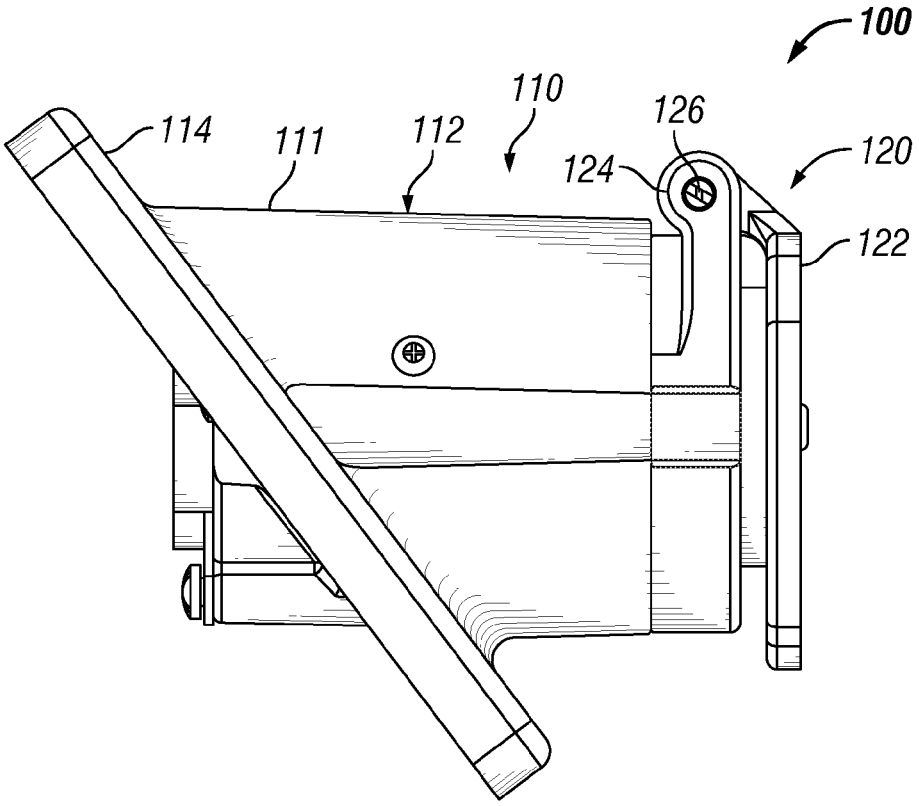
FIGS. 1A and 1B show various views of an electrical receptacle in accordance with certain example embodiments.

The drawings illustrate only example embodiments and are therefore not to be considered limiting of its scope, as other equally effective embodiments are within the scope and spirit of this disclosure. The elements and features shown in the drawings are not necessarily drawn to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

The example embodiments discussed herein are directed to systems, methods, and devices for lockout features for electrical receptacle assemblies. While example embodiments are directed herein to electrical receptacle assemblies for use in a hazardous location, other example embodiments can be used in other types of applications. Example embodiments can be used with electrical receptacles that are located in one or more of a variety of environments, indoors or outdoors, where the electrical receptacle (also referred to herein simply as a receptacle) can be exposed. Examples of such environments can include, but are not limited to, moisture, humidity, dirt, exhaust fumes, vibrations, potential explosions, and noise.

In one or more example embodiments, the electrical receptacle can be part of an explosion-proof enclosure and/or be located in a hazardous location. An explosion-proof enclosure (also known as a flame-proof enclosure or a hazardous location enclosure) is an enclosure that is configured to contain an explosion that originates inside the enclosure. Further, the explosion-proof enclosure is configured to allow gases from inside the enclosure to escape across joints of the enclosure and cool as the gases exit the explosion-proof enclosure. The joints are also known as flame paths and exist where two surfaces meet and provide an uninterrupted path, from inside the explosion-proof enclosure toward the outside of the explosion-proof enclosure, along which one or more gases may travel. A joint may be a mating of any two or more surfaces. Each surface may be any type of surface, including but not limited to a flat surface, a threaded surface, a rabbet surface, and a serrated surface.

In one or more example embodiments, an explosion-proof enclosure is subject to meeting certain standards and/or requirements. For example, NEMA sets standards with which an enclosure must comply in order to qualify as an explosion-proof enclosure. Specifically, NEMA Type 7, Type 8, Type 9, and Type 10 enclosures set standards with which an explosion-proof enclosure within a hazardous location must comply. For example, a NEMA Type 7 standard applies to enclosures constructed for indoor use in certain hazardous locations. Hazardous locations may be defined by one or more of a number of authorities, including but not limited to the National Electric Code (e.g., Class I, Division 1) and Underwriters' Laboratories, Inc. (UL) (e.g., UL 1203). For example, a Class I hazardous area under the National Electric Code is an area in which flammable gases or vapors may be present in the air in sufficient quantities to be explosive.

As a specific example, NEMA standards for an explosion-proof enclosure of a certain size (e.g., 100 $cm^3$) or range of sizes may require that in a Group B, Division 1 area, any flame path of an explosion-proof enclosure must be at least 1 inch long (continuous and without interruption), and the gap between the surfaces cannot exceed 0.0015 inches. Standards created and maintained by NEMA may be found at www.nema.org/stds and are hereby incorporated by reference.

Example embodiments can also be used with enclosures that are used in harardous or non-hazardous locations that are not required to meet the standards for an explosion-proof enclosure. For example, receptacle assemblies using example lockout features can be part of a NEMA Type 3R enclosure, which can be used indoors or outdoors and can provide a degree of protection against the ingress of solid foreign objects (e.g., dirt, dust), ingress of water (e.g., rain sleet, snow), and formation of ice on the enclosure.

The example receptacle assemblies (or components thereof) described herein can be made of one or more of a number of suitable materials to allow the receptacle assemblies to meet certain standards and/or regulations while also maintaining durability in light of the one or more conditions under which the receptacle assemblies can be exposed. Examples of such materials can include, but are not limited to, aluminum, stainless steel, fiberglass, glass, plastic, and rubber.

Example embodiments described herein can be used with electrical receptacles rated for one or more of a number of voltages and/or amperes. For example, an electrical receptacle using example embodiments can be rated for 20 amperes (A) and 250 volts (V). Therefore, example embodiments of lockout features for electrical receptacle assemblies described herein should not be considered limited to a particular voltage and/or amperage rating.

A user may be any person that interacts with an electrical receptacle using example embodiments described herein. Specifically, a user may install, maintain, operate, and/or interface with an electrical receptacle using example lockout features. Examples of a user may include, but are not limited to, an engineer, an electrician, an instrumentation and controls technician, a mechanic, an operator, a consultant, a contractor, and a manufacturer's representative.

Example embodiments of example lockout features for electrical receptacle assemblies will be described more fully hereinafter with reference to the accompanying drawings, in which example lockout features for electrical receptacle assemblies are shown. Lockout features may, however, be embodied in many different forms and should not be construed as limited to the example embodiments set forth herein. Rather, these example embodiments are provided so that this disclosure will be thorough and complete, and will fully convey the scope of lockout features for electrical receptacle assemblies to those or ordinary skill in the art. Like, but not necessarily the same, elements (also sometimes called components) in the various figures are denoted by like reference numerals for consistency. Terms such as "first," "second," "distal," "lower," "top," "middle," "bottom," "front," and "back" are used merely to distinguish one component (or part of a component) from another. Such terms are not meant to denote a preference or a particular orientation.

Further, for any figures described below, labels not shown in such figures but referred to with respect to such figures can be incorporated by reference from one or more figures previously described herein. Similarly, a description of a label shown in certain but not described with respect to such figures can use the description from figures previously described herein.

Figure 1B:
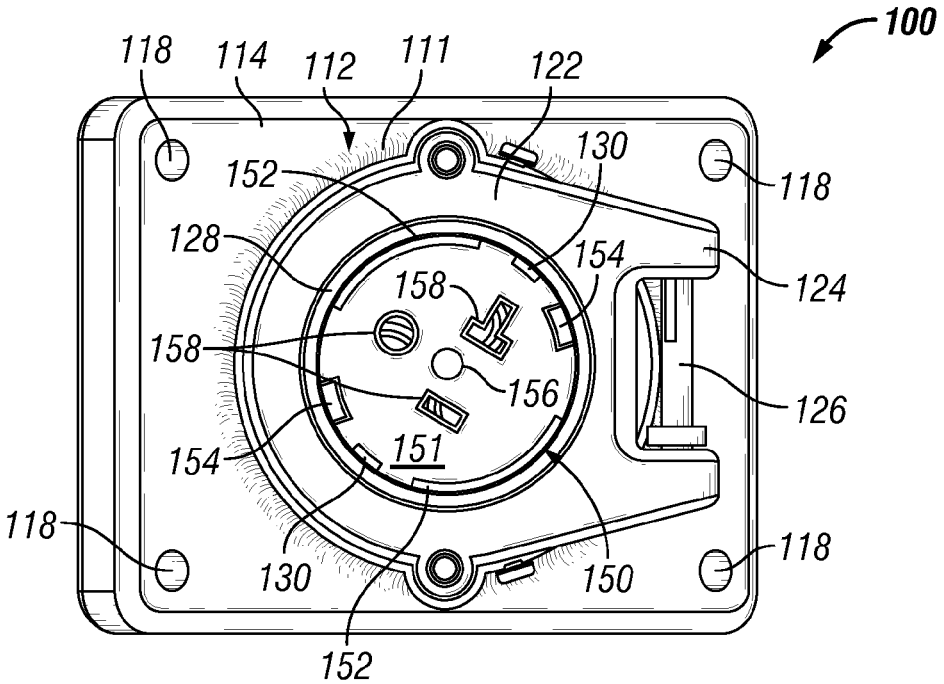

FIGS. 1A and 1B show various views of an electrical receptacle 100 in accordance with certain example embodiments. Specifically, FIG. 1A shows a side view of the electrical receptacle 100, and FIG. 1B shows a top view of the electrical receptacle 100 (with a portion of the cover assembly 120 of the housing 110 removed). In one or more example embodiments, one or more of the components shown in FIGS. 1A and 1B may be omitted, repeated, and/or substituted. Accordingly, example embodiments of an electrical receptacle (or portions thereof) should not be considered limited to the specific arrangements of components shown in FIGS. 1A and 1B.

Referring now to FIGS. 1A and 1B, the electrical receptacle 100 can include the housing 110 and a faceplate 150. The housing can include the cover assembly 120. The housing 110 can include a base portion 114 that is configured to mechanically couple to a body of an enclosure (e.g., a junction box, an explosion-proof enclosure, a motor control center). The base portion 114 can include one or more coupling features 118 (in this case, apertures) that are configured to couple to corresponding coupling features of the body on the enclosure. The coupling features 118 of the base portion 114 can include, but are not limited to, apertures, slots, clips, clamps, and tabs. The base portion 114 can mechanically couple to the body of an enclosure using one or more of a number of coupling methods, including but not limited to fastening devices (e.g., bolts), welding, compression fittings, and bracketing.

The housing 110 can also include at least one wall 112 that extends from the base portion 114 at some angle. The wall 112 can have an inner surface (hidden from view) and an outer surface 111. The wall 112 can form a cavity, defined by the inner surface of the wall 111, into which one or more components (e.g., the faceplate 150) of the electrical receptacle 100 can be disposed. The cavity formed by the wall 112 is described below with respect to FIGS. 2A and 2B.

The cover assembly 120 of the housing 110 can be used to protect and provide access to the faceplate 150 when an electrical plug is not engaged with the faceplate 150. The cover assembly 120 can include a base 122, a cover (removed to show the faceplate 150), a hinge pin 126 disposed in an end section 124 of the base 122 and in the cover to allow the cover to hingedly rotate relative to the base 122. Removal of the cover of the cover assembly 120 also exposes the upper lip 128 of the housing 110. In addition, as shown in FIG. 1B, two locking keys 130 are disposed on the inner surface of the wall 112 of the housing. The locking keys 130 can extend inward and overlap part of the faceplate 150.

In certain example embodiments, the faceplate 150 includes a top surface 151, one or more terminal receivers 158 that traverse the faceplate 150, at least one lug 152, at least one locking key receiver 154, and at least one rejection feature 156 disposed on the top surface 151, The terminal receivers 158 are configured to receive terminals disposed on an electrical plug (also merely called a plug) (not shown). Each of the terminal receivers 158 can have a unique shape and/or size relative to the other terminal receivers 158. In addition, when there are multiple terminal receivers 158, the terminal receivers 158 can be spaced and/or oriented in a certain way relative to each other on the faceplate 150. Due to the shape, size, orientation, and spacing of the terminal receivers 158, the terminal receivers 158 can only accept the terminals of a specific type of electrical plug. In such a case, user safety can be increased, as only an electrical plug of the proper voltage and/or amperage rating can be mechanically and electrically coupled to the electrical receptacle 100.

The at least one lug 152 can extend upward from the top surface 151 and be disposed along a portion of the outer perimeter of the top surface 151. Thus, if the shape of the top surface 151 is circular, as shown in FIG. 1B, than each lug 152 forms an arc. The thickness of a lug 152 can vary, but is generally significantly less than the length of the lug. When there are multiple lugs 152, the shape and size (e.g., height, length, thickness) can be substantially the same for each lug 152. In addition, or in the alternative, the spacing between multiple lugs 152 can be substantially the same. In certain example embodiments, the positioning, spacing, and size of the lugs 152 depend on the spacing and size of the locking keys 130 disposed on the inner surface of the wall 112 of the housing 110.

The at least one locking key receiver 154 can form a recess in the faceplate 150 that extends downward from the top surface 151. Each locking key receiver 154 can be disposed along a portion of the outer perimeter of the top surface 151. Each locking key receiver 154 can have one or more of a number of shapes, including but not limited to an arc, a linear segment, and a random shape. When there are multiple locking key receivers 154, the shape and size (e.g., height, length, thickness) can be substantially the same for each locking key receiver 154. In addition, or in the alternative, the spacing between multiple locking key receivers 154 can be substantially the same.

In certain example embodiments, the positioning, spacing, and size of the locking key receivers 154 depend on the spacing and size of the locking keys 130 disposed on the inner surface of the wall 112 of the housing 110. In any case, the shape and size of a locking key receiver 154 is at least slightly larger than the shape and size of a corresponding locking key 130 so that the locking key 130 can be disposed within a locking key receiver 154. There can be at least as many locking key receivers 154 as there are locking keys 130.

The rejection feature 156 disposed on the top surface 151 of the faceplate 150 is a device used to help ensure that a plug of the proper voltage and/or amperage rating can be mechanically and electrically coupled to the electrical receptacle 100. In this example, the rejection feature 156 is a cylindrical tab that extends upward from top surface 151 and can be disposed in a corresponding recess of a proper plug. If the plug is not proper (e.g., does not have the appropriate recess of the appropriate shape and size in the appropriate location to receive the rejection feature 156), the terminals of the plug will not be received by the terminal receivers 158 of the faceplate 150.

The rejection feature 156 can have any of a number of shapes, sizes, and/or features, as long as the proper plug has a complementary shape, size, and/or features. For example, a rejection feature 156 can be a triangular recess, a rectangular tab, or a slot. There can be more than one rejection feature 156 disposed on the top surface 151 of the faceplate 150. The faceplate 150 is described in more detail below with respect to FIGS. 6A and 6B.

Figure 2A:
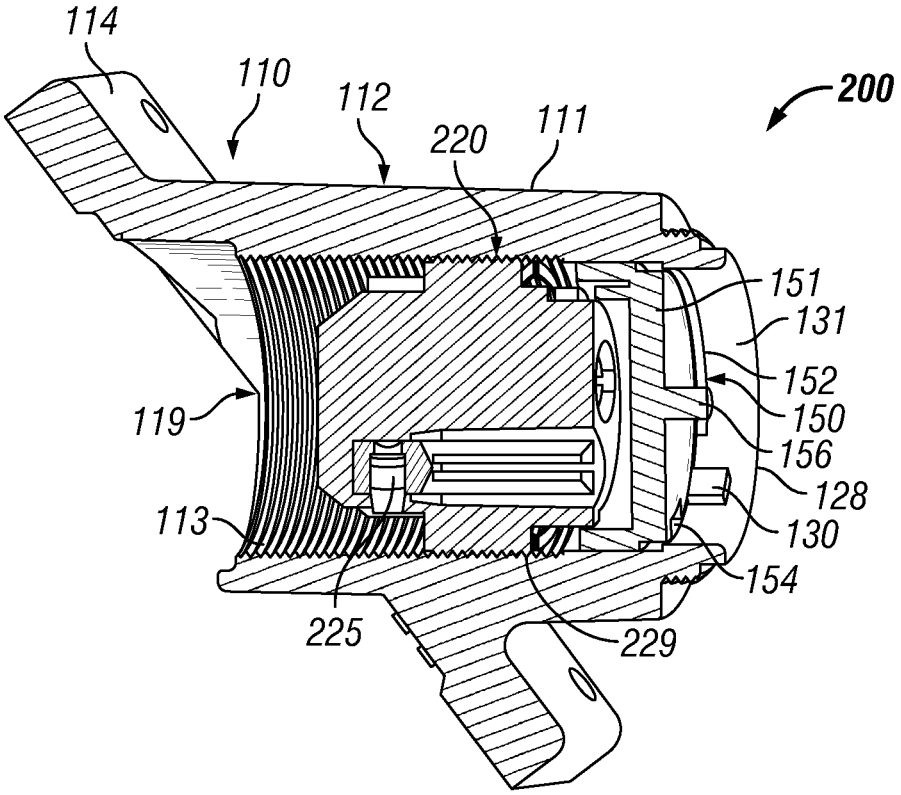
FIGS. 2A and 2B show various views of a portion of the electrical receptacle of FIGS. 1A and 1B in accordance with certain example embodiments.
Figure 2B:
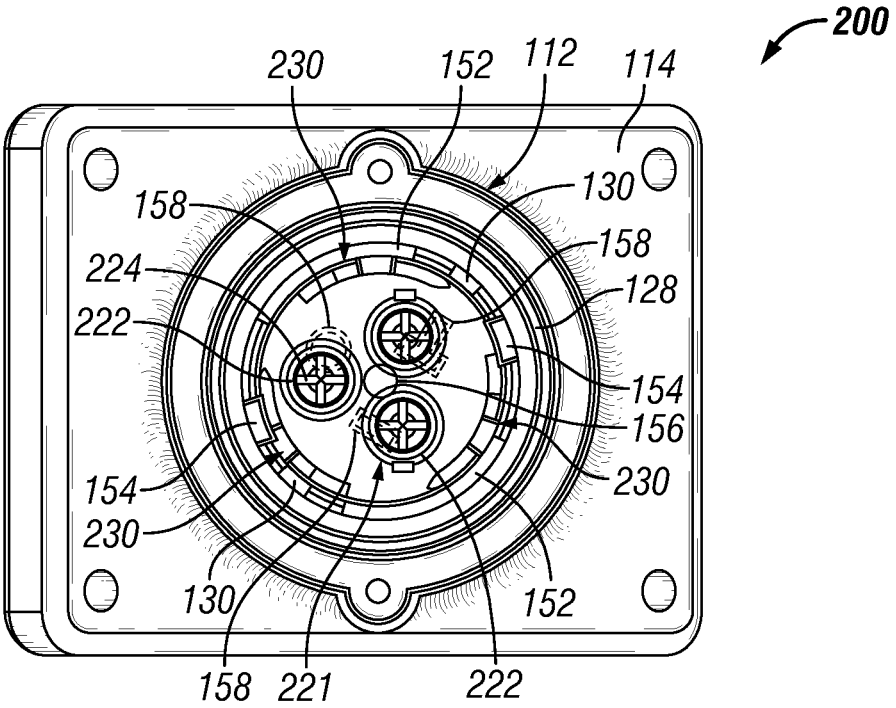

FIGS. 2A and 2B show various views of a portion 200 of the receptacle of FIGS. 1A and 1B in accordance with certain example embodiments. Specifically, FIG. 2A shows a cross-sectional side perspective view of the portion 200 of the receptacle, and FIG. 2B shows a top view (with the faceplate 150 shown in transparency) of the portion 200 of the receptacle. In one or more example embodiments, one or more of the components shown in FIGS. 2A and 2B may be omitted, repeated, and/or substituted. Accordingly, example embodiments of an electrical receptacle (or portions thereof) should not be considered limited to the specific arrangements of components shown in FIGS. 2A and 2B.

Referring to FIGS. 1A-2B, the cavity 119 formed by the inner surfaces (e.g., inner surface 113, inner surface 131) of the wall 112 of the housing 110 is shown. The cavity 119 also traverses the base portion 114 of the housing 110. Also shown in FIGS. 2A and 2B is the outer body 220 disposed within the cavity 119. Specifically, the outer body 220 is shown mechanically coupled to inner surface 113 of the wall 112. The inner surface 113 of the wall 112 and/or the outer surface 229 of the outer body 220 can have one or more coupling features that allow the outer body 220 to mechanically couple to the wall 112. In addition, such features allow for rotational movement of the outer body 220 within the cavity 119 formed by the wall 112 of the housing 110.

Examples of such features can include, but are not limited to, mating threads, slots, tabs, detents, and clips. In the example shown in FIG. 2A, mating threads are disposed along the inner surface 113 of the wall 112, while complementary mating threads are disposed on the outer surface 229 of the outer body 220. The mating threads allow the outer body 220 to rotate within the cavity 119 formed by the wall 112. If the receptacle is used with an explosion-proof enclosure, then the junction between the outer surface 229 of the outer body 220 and the inner surface 113 of the wall 112 of the housing 110 can form a flame path.

In certain example embodiments, the outer body 220 is mechanically coupled to the faceplate 150. Inside of the outer body 220 can be positioned one or more terminal receivers 221. Each terminal receiver 221 can include an aperture 222 disposed in the top surface of the outer body 220. Each aperture 222 can traverse some or all of the height of the outer body 220. Disposed within each aperture 222 is a pin assembly 224 of the terminal receiver 221. The pin assembly 224 is made of an electrically conductive material so that electricity can flow therethrough and/or so that an electrical ground connection can be secured.

The pin assembly 224 can have one or more of a number of configurations. The purpose of each pin assembly 224 is to receive a terminal from a plug and provide substantial mechanical contact with the terminal so that the electrical coupling between the pin assembly 224 and the terminal of the plug is consistent and not subject to arcing, faults, or other adverse conditions that can lead to a disruption in the flow of electricity between the terminal of the plug and the pin assembly 224. In this case, as shown in FIG. 2B, the pin assembly 224 is circular with four quadrants that are divided by two breaks that run along the diameter through the center and are perpendicular to each other.

When a terminal from an electrical plug is inserted into the terminal receiver 221, the pin assembly 224 can expand while applying a sufficient inward force toward the terminal, thus maintaining solid mechanical contact with the terminal, which leads to solid and consistent electrical contact between the terminal and the pin assembly 224. For a terminal of an electrical plug to be inserted into the terminal receiver 221 of the outer body 220, the faceplate 150 must be in the proper position. Specifically, the terminal receivers 158 that traverse the faceplate 150 must be aligned with the corresponding terminal receivers 221 of the outer body 220.

FIG. 2B shows a case where the terminal receivers 158 of the faceplate 150 are not aligned with the corresponding terminal receivers 221 of the outer body 220. Thus, terminals from a proper electrical plug could not be inserted into the terminal receivers 221 of the outer body 220 unless the faceplate 150 is rotated. Specifically, the faceplate 150 must be rotated so that the locking keys 130 disposed on the inner surface 131 of the housing 110 are aligned with the locking key receivers 154 of the faceplate 150.

In certain example embodiments, an extension 225 is attached to the bottom end of the pin assembly 224. The extension 225 can be made of an electrically conductive material, which can be the same or different than the material of the pin assembly 224. The extension 225 can be used to contact another electrically conductive element positioned adjacent to the lower end of the outer body 220 when the outer body 220 is rotated into a certain position. In such a case, the distal end of the extension 225 protrudes through, or is accessible at, an aperture disposed at the lower end of the outer body 220. The extension 225 can form a single piece (as from a mold) with the pin assembly 224. Alternatively, the extension 225 can be a separate piece that is mechanically coupled to the pin assembly 224 using one or more of a number of coupling methods, including but not limited to welding, fastening devices, and compression fittings.

The outer body 220 can also include at least one driven feature 230. The driven feature 230 can be disposed on the top surface of the outer body 220 toward the outer perimeter. In addition, or in the alternative, the driven feature 230 can be disposed on the outer surface of a top section of the outer body 220. Each driven feature 230 can be moveably coupled with a bottom side of the faceplate 150. Details of the driven feature 230, as well as other features of the outer body 220, are shown more clearly with respect to FIGS. 7A and 7B below.

Figure 3:
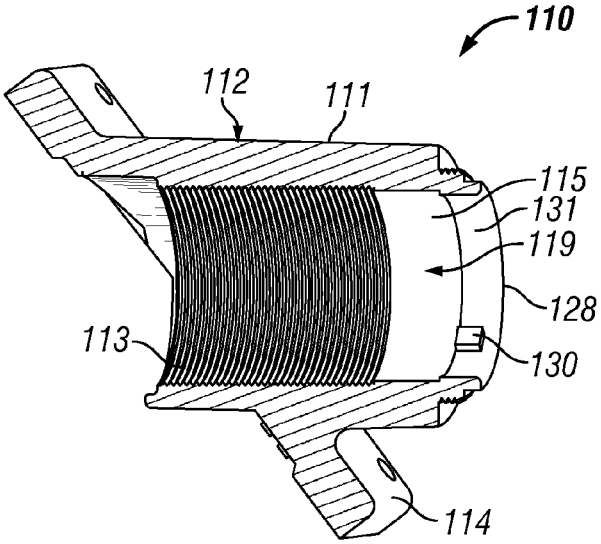
FIG. 3 shows a cross-sectional side view of a housing of the electrical receptacle of FIGS. 1A and 1B in accordance with certain example embodiments.

FIG. 3 shows a cross-sectional side perspective view of the housing 110 (without the cover assembly) of the receptacle of FIGS. 1A and 1B in accordance with certain example embodiments. As discussed above, there can be multiple inner surfaces of the wall 112 of the housing 110. In this example, there are three adjacent inner surfaces that form the cavity 119 that traverses the housing 110. Toward the bottom end of the wall 112 is the inner surface 113 described above, having mating threads disposed thereon for coupling to the outer surface 229 of the outer body 220.

Located above the inner surface 113 is inner surface 115. In certain example embodiments, inner surface 115 is smooth and has no features disposed thereon. The inner surface 115 can have a size and/or shape to receive at least a portion of the faceplate 150. In such a case, the faceplate 150 can freely rotate horizontally and also have limited vertical movement within the cavity 119. The outer perimeter of the inner surface 115 can be substantially the same as, or different than, the outer perimeter of the inner surface 113.

Located above the inner surface 115 is inner surface 131. Inner surface 131 can also be smooth, like inner surface 115. However, inner surface 131 can have at least one locking key 130 disposed on the inner surface 131. The inner surface 131 can have a size and/or shape to receive at least a portion of the faceplate 150. In such a case, the faceplate 150 can have limited horizontal rotation and limited vertical movement within the cavity 119, limited in both cases by the locking key 130. The outer perimeter of the inner surface 131 can be substantially the same as, or different than, the outer perimeter of the inner surface 115. For example, in this case, the outer perimeter of the inner surface 131 is slightly smaller than the outer perimeter of the inner surface 115.

Figure 4:
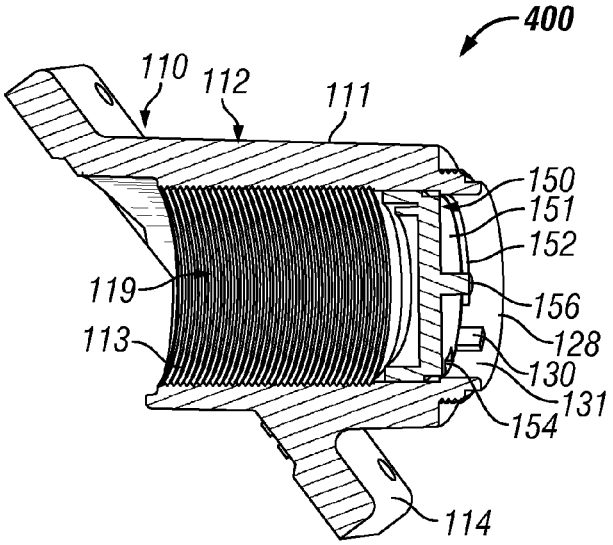
FIG. 4 shows a cross-sectional side view of a housing and faceplate of the electrical receptacle of FIGS. 1A and 1B in accordance with certain example embodiments.

FIG. 4 shows a cross-sectional side perspective view of the housing 110 (without the cover assembly) and the faceplate 150 of the receptacle of FIGS. 1A and 1B in accordance with certain example embodiments. Specifically, the faceplate 150 is shown disposed inside the cavity 119 of the housing 110. The bottom side of the faceplate 150 is disposed adjacent to the inner surface 115, while the top side of the faceplate 150 is disposed adjacent to the inner surface 131.

As shown in FIG. 4, the locking key 130 can be in contact with the top surface 151 of the faceplate 150. Specifically, as the faceplate 150 rotates in a limited scope the locking key can abut against a lug 152, within a locking key receiver 154, or against the top surface 151 of the faceplate between the lug 152 and the locking key receiver 154. Thus, the rotation of the faceplate 150 is limited, at least in part, by the locking key 130 abutting against a lug 152 in one direction, and by the locking key 130 being disposed within the locking key receiver 154 in an opposite direction.

Figure 5:
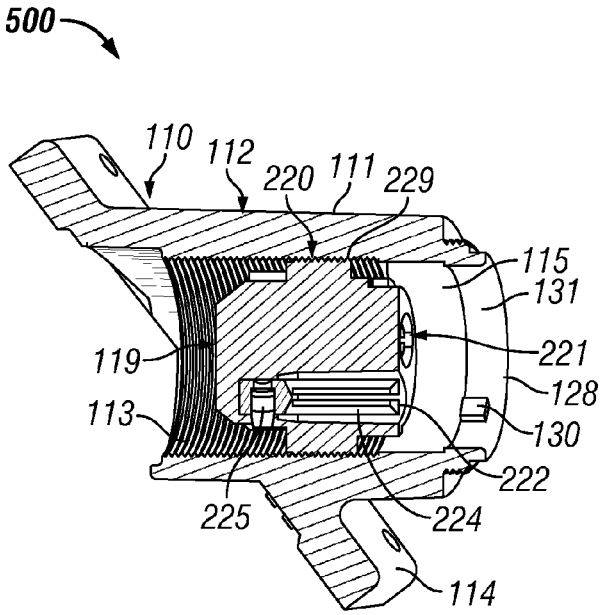
FIG. 5 shows a cross-sectional side view of a housing and outer body of the electrical receptacle of FIGS. 1A and 1B in accordance with certain example embodiments.

FIG. 5 shows a cross-sectional side perspective view of the housing 100 (without the cover assembly) and the outer body 220 of the receptacle of FIGS. 1A and 1B in accordance with certain example embodiments. As can be seen, the outer surface 229 of the central portion of the outer body 220 is disposed in the cavity 119 and threadably coupled to the inner surface 113 of the wall 112. Between the housing 112 and the outer body 220, there may be no features that limit the amount of rotation for the outer body 220.

In addition, at least a top portion 777 (defined with respect to FIGS. 7A and 7B below) of the outer body 220 is adjacent to the inner surface 115 of the wall 112 rather than the inner surface 113. In other words, the coupling features of the inner surface 113 terminate within the height (before reaching the top end) of the outer body 220. As stated above, the inner surface 115 lacks the coupling features (e.g., mating threads) that are disposed on the inner surface 113. This allows the faceplate 150 to freely move while engaging the top portion 777 of the outer body 220.

Figure 6A:
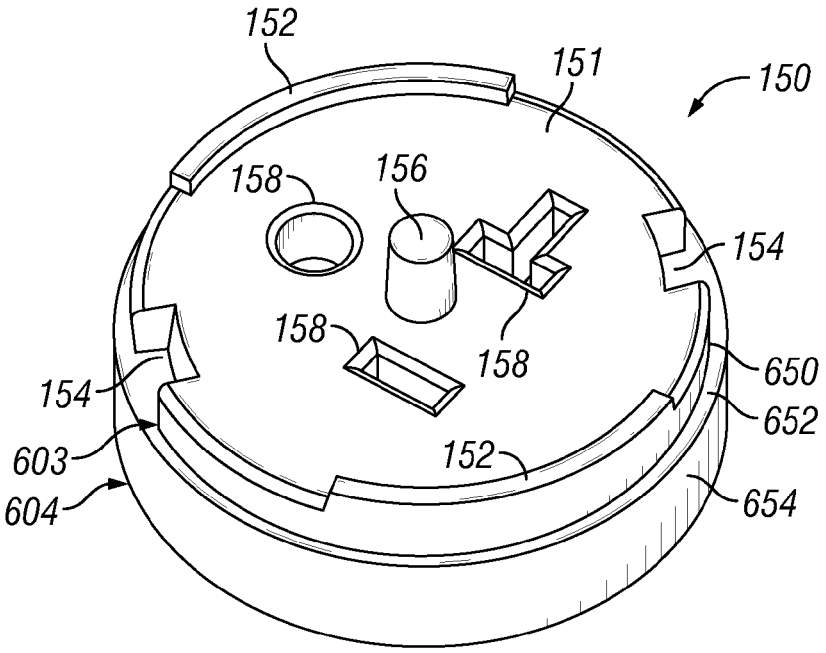
FIGS. 6A and 6B show various views of a faceplate in accordance with certain example embodiments.
Figure 6B:
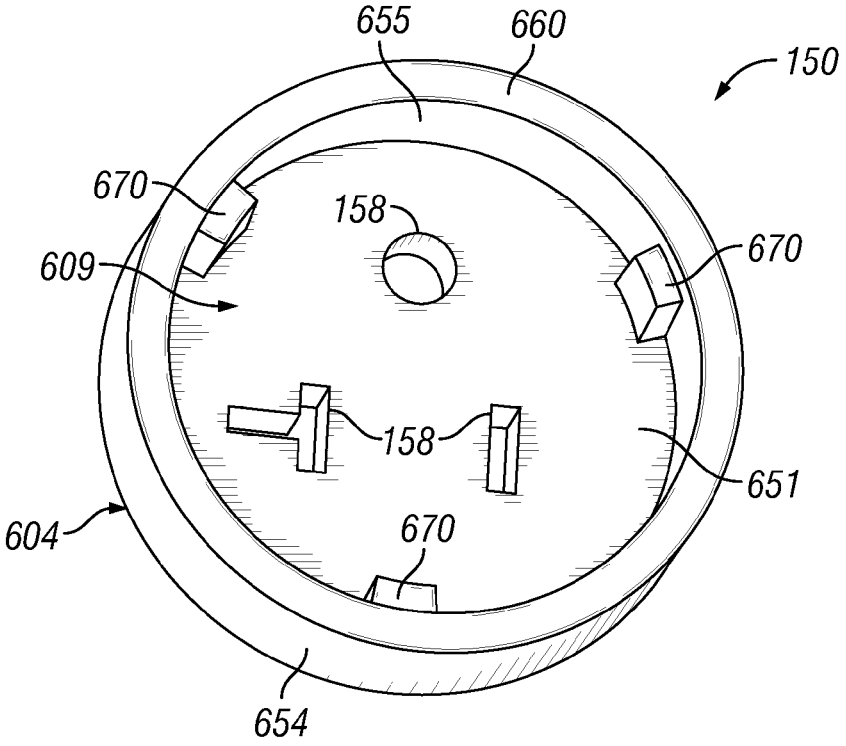

FIGS. 6A and 6B show various views of the faceplate 150 in accordance with certain example embodiments. Specifically, FIG. 6A shows a top perspective view of the faceplate 150, and FIG. 6B shows a bottom perspective view of the faceplate 150. In one or more example embodiments, one or more of the components shown in FIGS. 6A and 6B may be omitted, repeated, and/or substituted. Accordingly, example embodiments of the faceplate should not be considered limited to the specific arrangements of components shown in FIGS. 6A and 6B.

Referring to FIGS. 1A-6B, the faceplate 150 can have one or more of a number of different portions. For example, as shown in FIG. 6A, the faceplate 150 can have a top portion 603 and a bottom portion 604. In this example, the top portion 603 and the bottom portion 604 are concentric, with the top portion 603 having a slightly smaller outer perimeter than the bottom portion 604. The gap formed between the top portion 603 and the bottom portion 604 forms a shelf 652. The top surface 151, the lugs 152, the locking key receivers 154, and the rejection feature 156 are all disposed on the top portion 603. In addition, the terminal receivers 158 traverse the top portion 603. While there are two lugs 152 and two locking key receivers 154 shown in FIG. 6A, there can be one of one or both and/or more than two of one or both.

Figure 7A:
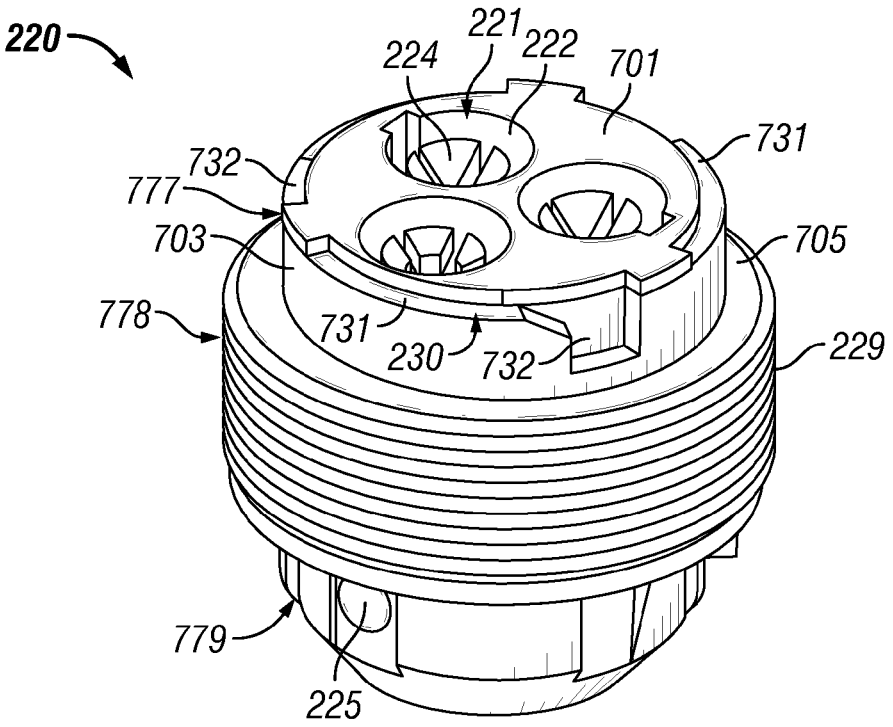
FIGS. 7A and 7B show various views of an outer body in accordance with certain example embodiments.
Figure 7B:
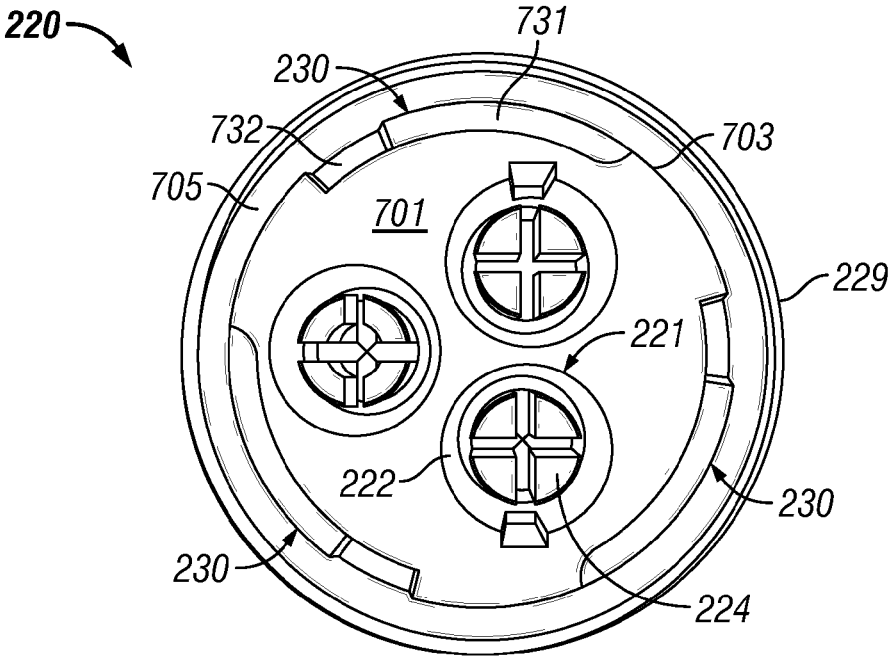

The bottom portion 604 can form a cavity 609 on its underside. The cavity 609 can be formed by the bottom surface 651 of the top portion 603 and an inner wall 655. In certain example embodiments, the top portion 777 of the outer body 220, as described below with respect to FIGS. 7A and 7B, is disposed inside the cavity 609. In certain example embodiments, disposed on at least one surface (e.g., the inner wall 655) of the faceplate 150 is one or more driving features 670. For example, as shown in FIGS. 6A and 6B, each driving feature 670 can be a protraction inward from the inner wall 655 and have any of a number of shapes and/or sizes. If there are multiple driving features 670, each can be the same and/or different from each other. In addition, or in the alternative, driving features 670 can be disposed on one or more other surfaces (e.g., outer wall 654, bottom edge 660) of the faceplate 150. The positioning, shape, size, and spacing of the driving features 670 can complement the positioning, shape, size, and spacing of the driven features 230 on the outer body 220.

Similarly, the height of the bottom portion 604 can vary, based at least in part on the height of the top portion 777 of the outer body 220. The bottom portion 604 of the faceplate 150 can have a thickness along the bottom edge 660, where the thickness is measured between the inner wall 655 and the outer wall 654 of the bottom portion 604. The thickness of the bottom portion 604 (or, put another way, the perimeter of the inner wall 655) can vary, but is at least slightly greater than the outer perimeter of the top portion 777 of the outer body 220.

FIGS. 7A and 7B shows various views of the outer body 220 in accordance with certain example embodiments. Specifically, FIG. 7A shows a top perspective view of the outer body 220, and FIG. 7B shows a top view of the outer body 220. In one or more example embodiments, one or more of the components shown in FIGS. 7A and 7B may be omitted, repeated, and/or substituted. Accordingly, example embodiments of the outer body should not be considered limited to the specific arrangements of components shown in FIGS. 7A and 7B.

Referring to FIGS. 1A-7B, the outer body 220 can have one or more of a number of different portions. For example, as shown in FIG. 7A, the outer body 220 can have a top portion 777, a middle portion 778, and a bottom portion 779. In this example, all portions are concentric, with the top portion 777 and the bottom portion 779 having substantially the same outer perimeter, which is slightly smaller than the outer perimeter than the middle portion 778. The gap formed between the top portion 777 and the middle portion 778 forms a shelf 705.

The top surface 701, the outer surface 703, the driven features 230, and the apertures 222 of the terminal receivers 221 can all disposed on the top portion 777. In some cases, one or more of the driven features 230 can be disposed on the middle portion 778 (e.g., disposed in and/or on the shelf 705). In addition, the pin assemblies 224 of the terminal receivers 221 traverse the top portion 777 and at least a portion of the middle portion 778. While there are two driven features 230 shown in FIG. 6A, there can be one or more than one driven feature 230. In certain example embodiments, there are at least as many driven features 230 on the outer body 220 as there are driving features 670 on the faceplate 150. The positioning, shape, size, and spacing of the driven features 230 can complement the positioning, shape, size, and spacing of the driving features 670 on the faceplate 150.

Each driven feature 230 of the outer body 220 can include one or more of a number of features. For example, as shown in FIGS. 7A and 7B, each driven feature 230 can include an optional ramp 731 and a receiving slot 732. In such a case, each of the one or more optional ramps 731, located adjacent to a receiving slot 732, can be used to help maintain the faceplate 150 in a certain position when the faceplate 150 is not properly aligned within the cavity 119 of the housing 110. In other words, if the locking keys 130 are not aligned with the locking key receivers 154 of the faceplate 150, then a driving feature 670 of the faceplate 150 is disposed on a ramp 731 rather than within the receiving slot 732.

If one or more driving features 670 of the faceplate is disposed on one or more ramps 731, a proper electrical plug inserted into the terminal receivers 158 of the faceplate 150 can realign the faceplate 150 (align the locking key receivers 154 with the locking keys 130) by applying an inward and rotational force to the faceplate 150, where the rotational force is directs the locking key receivers 154 away from the lugs 152 of the faceplate 150 and toward the locking keys 130. When this occurs, the terminal receivers 158 of the faceplate 150 can be aligned with the terminal receivers 221 of the outer body 220.

When the faceplate 150 is rotated, using the properly configured electrical plug, far enough toward the receiving slot 732 (and, also, when a sufficient downward force is applied to the faceplate 150 as the faceplate 150 is rotated), the driving feature 670 is disposed inside the receiving slot 732. In certain example embodiments, the receiving slot 732 has a sufficient depth, apart from the depth of the ramp 731, to receive a substantial portion of the driving feature 670. As defined herein, a substantial portion is an amount of the driving feature 670 sufficient to allow the faceplate 150 to use the leverage created by the driving feature 670 being seated within the receiving slot 732 to rotate the outer body 220 within the cavity 119 of the housing 110. As described below, such rotation can be in the opposite direction of the direction used to dispose the driving feature 670 into the receiving slot 732.

If the locking key receivers 154 are already aligned with the locking keys 130, then the faceplate 150 does not need to be rotated. Rather, only an inward force, using a properly configured electrical plug, can be applied to the faceplate 150 to seat the driving features 670 of the faceplate 150 within the receiving slots 732 of the outer body 220. At the same time, this action allows the terminals of the electrical plug to be inserted into the terminal receivers 221 of the outer body 220.

The middle portion 778 is where the coupling feature (in this case, mating threads) are disposed on the outer surface 229. Thus, the middle portion 778 is mechanically coupled to the inner surface 113 of the wall 112. The bottom portion 779 is where the extension 225 of the terminal receiver 221 of the outer body 220 is exposed for contact with another electrical conductor when the outer body 220 is positioned a certain way within the cavity 119 of the housing 110.

Figure 8A:
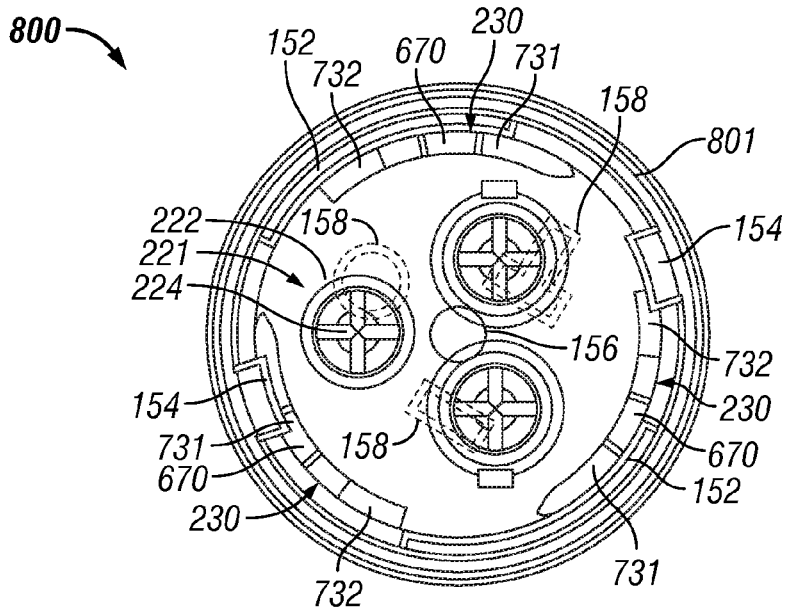
FIG. 8A-8C show various views of a portion of the electrical receptacle in accordance with certain example embodiments.
Figure 8B:
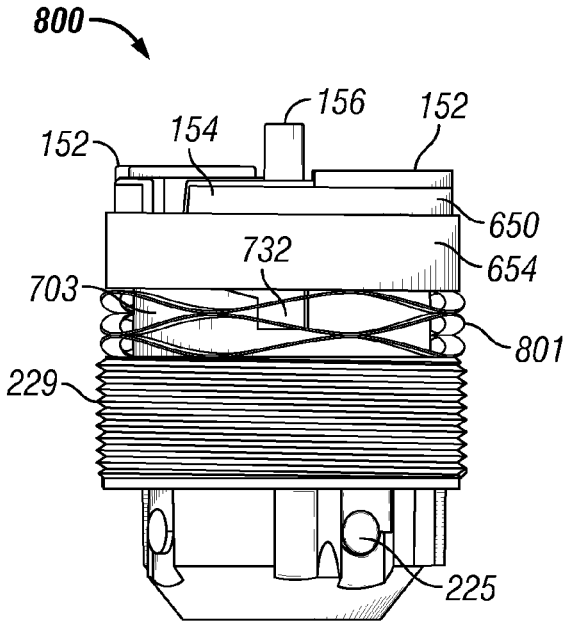
Figure 8C:
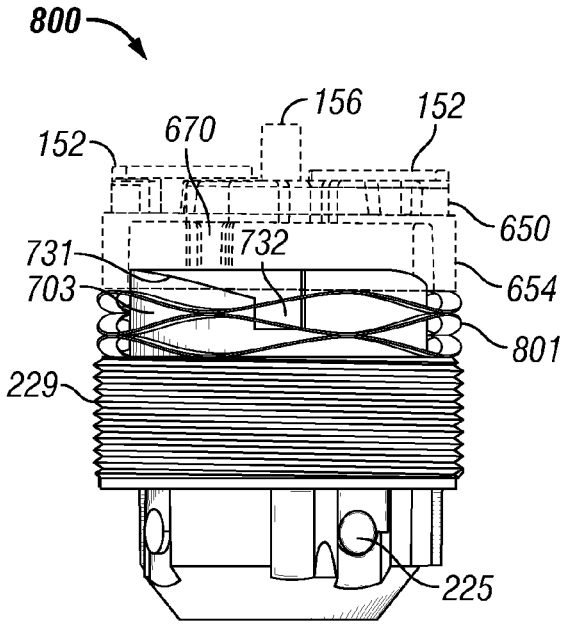

FIG. 8A-8C show various views of a portion 800 of the electrical receptacle in accordance with certain example embodiments. Specifically, FIG. 8A shows a semi-transparent top view of the portion 800 of the electrical receptacle. FIG. 8B shows a side view of the portion 800 of the electrical receptacle, and FIG. 8C shows a semi-transparent side view of the portion 800 of the electrical receptacle. In one or more example embodiments, one or more of the components shown in FIGS. 8A-8C may be omitted, repeated, and/or substituted. Accordingly, example embodiments of electrical receptacles (or portions thereof) should not be considered limited to the specific arrangements of components shown in FIGS. 8A-8C.

Referring to FIGS. 1A-8C, the portion 800 of the electrical receptacle includes the faceplate 150, the outer body 220, and a compressive member 801. In certain example embodiments, the compressive member 801 is used to apply a force that tends to separate the faceplate from the outer body 220. The compressive member 801 can be one or more of any number of devices. For example, as shown in FIGS. 8A-8C, the compressive member 801 can be a wavespring that is disposed around the outer surface 703 of the upper portion 777 of the outer body 220, where one end of the compressive member 801 abuts the shelf 705 of the outer body 220 and the other end of the compressive member 801 abuts the bottom edge 660 of the faceplate 150.

In addition, or in the alternative, the compressive member 801 can be positioned in one or more other locations. For example, one or more compressive members 801 can be positioned between the bottom surface 651 of the top portion 603 of the faceplate 150 and the top surface 701 of the top portion 777 of the outer body 220. The compressive member 801 can provide an upward force on the faceplate 150. Such a force can be called a compressive force.

The compressive member 801 can have a natural state and a compressed state. The compressive member 801 is in a natural state is when no appreciable force (e.g., a downward force) is applied to the compressive member 801. The compressive member 801 is in a compressed state is when a downward force applied on the faceplate (for example, by an electrical plug) is greater than the compressive force of the compressive member 801. The compressive member 801 can experience such a downward force when the faceplate 150 is simultaneously rotated, using a properly configured electrical plug, so that the driving features 670 of the faceplate 150 are rotated toward the receiving slot 732, if the locking key receivers 158 are not already aligned with the locking keys 130. FIGS. 8A-8C show where each driving feature 670 is approximately halfway down the respective ramp 731 of the driven features 230. Thus, the locking features 158 are not aligned with the locking keys 130.

Figure 9A:
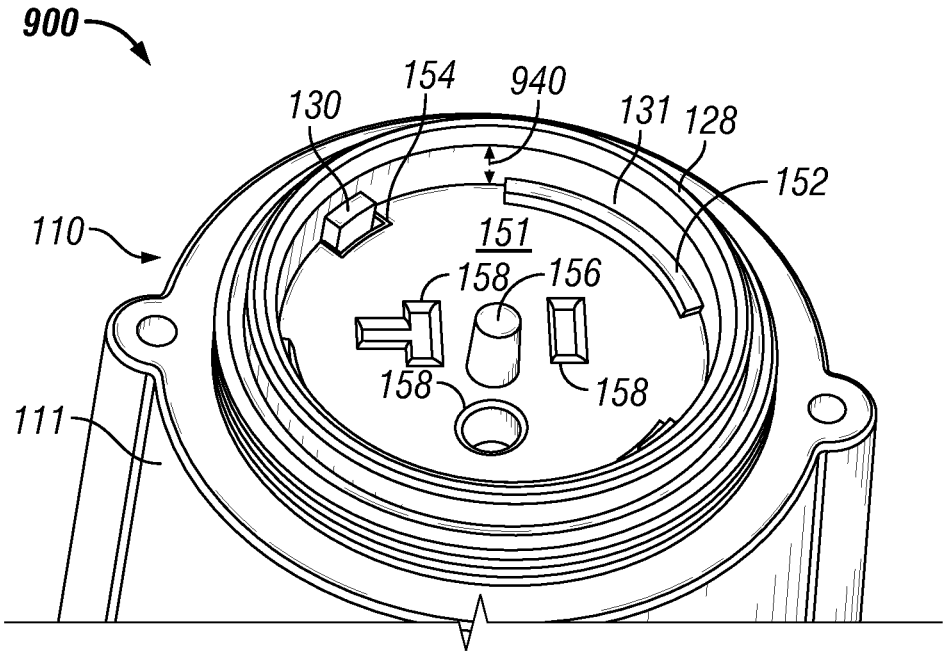
FIGS. 9A and 9B show various views of a portion of the electrical receptacle with the faceplate in the "home" position in accordance with certain example embodiments.
Figure 9B:
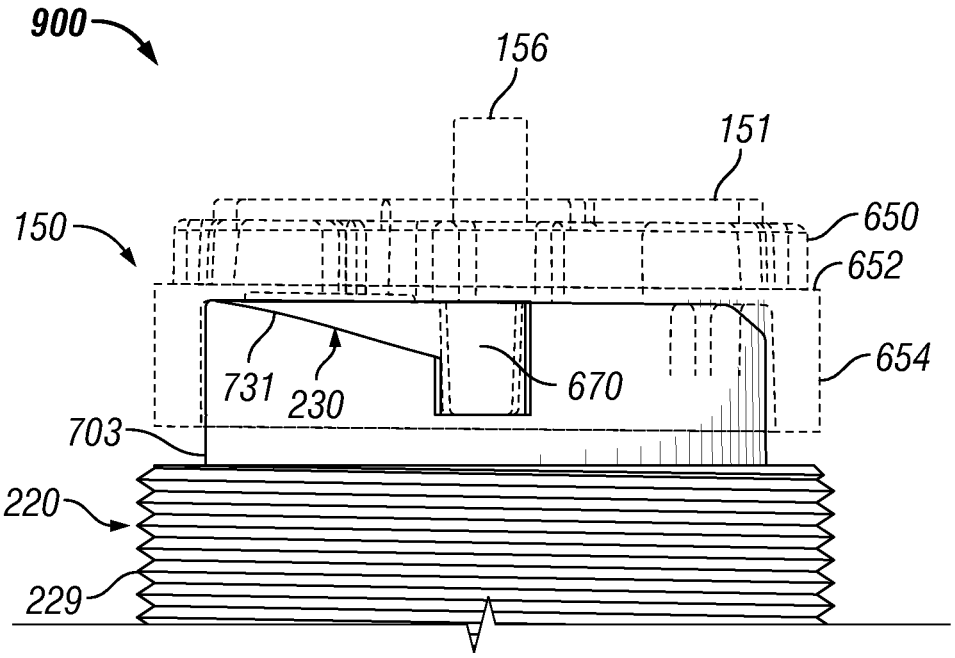
Figure 10A:
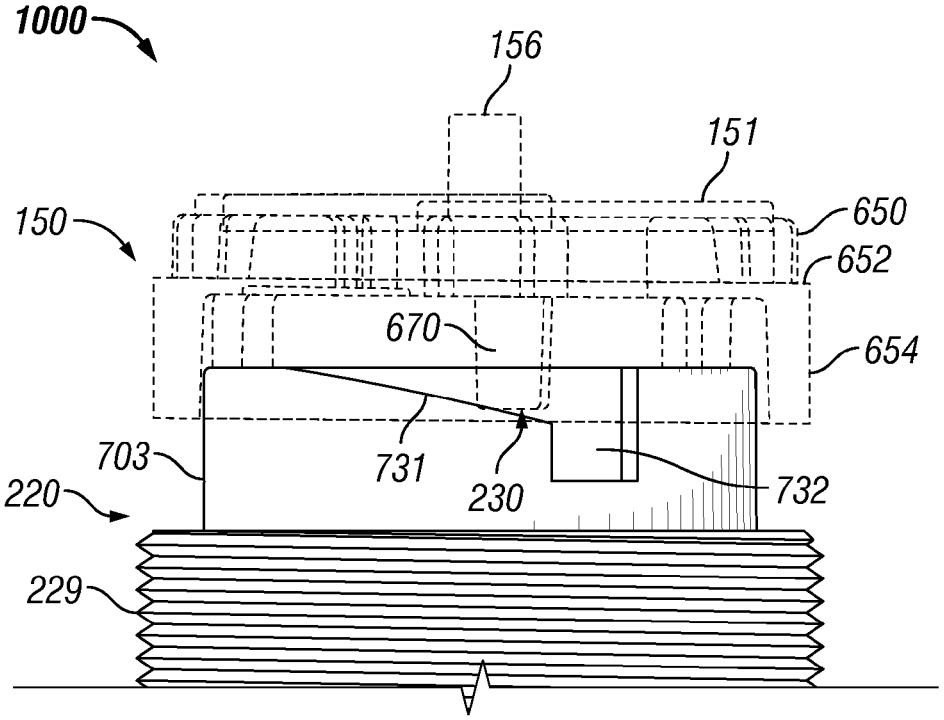
FIGS. 10A-10C show various views of a portion of the electrical receptacle with the faceplate out of the "home" position in accordance with certain example embodiments.
Figure 10B:
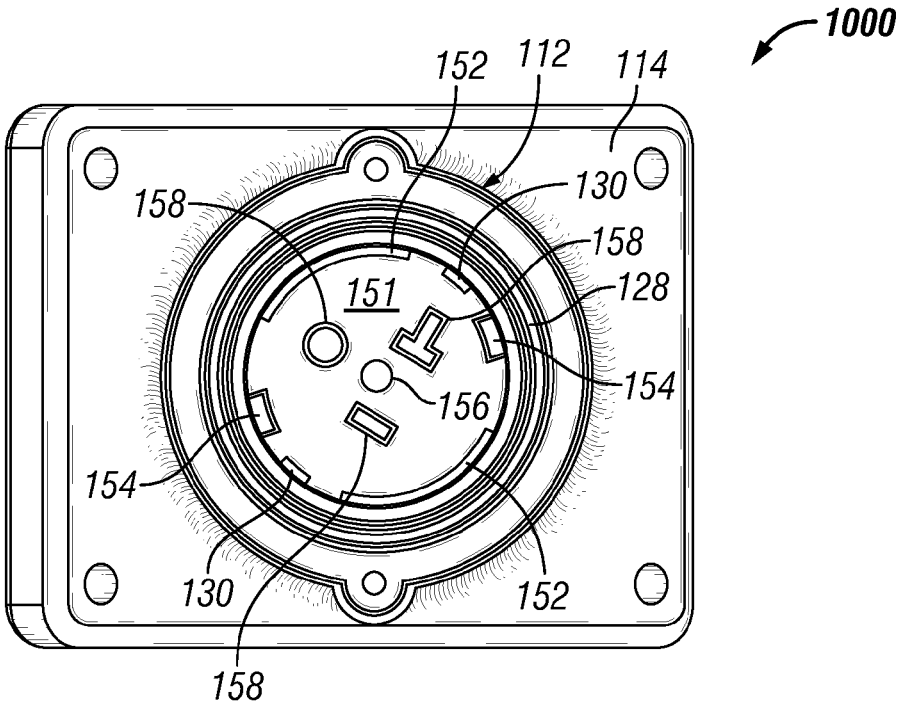
Figure 10C:
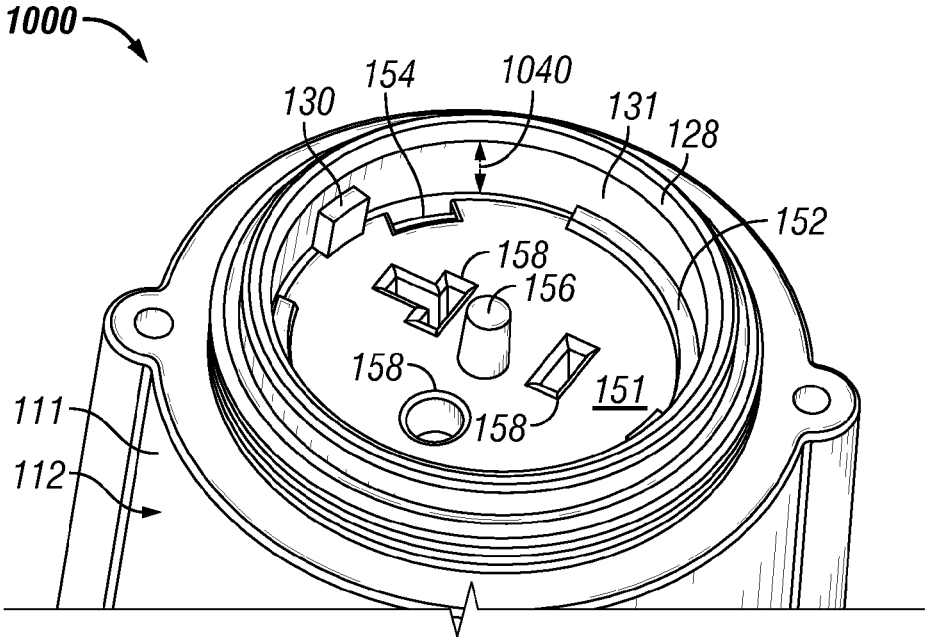
Figure 11:
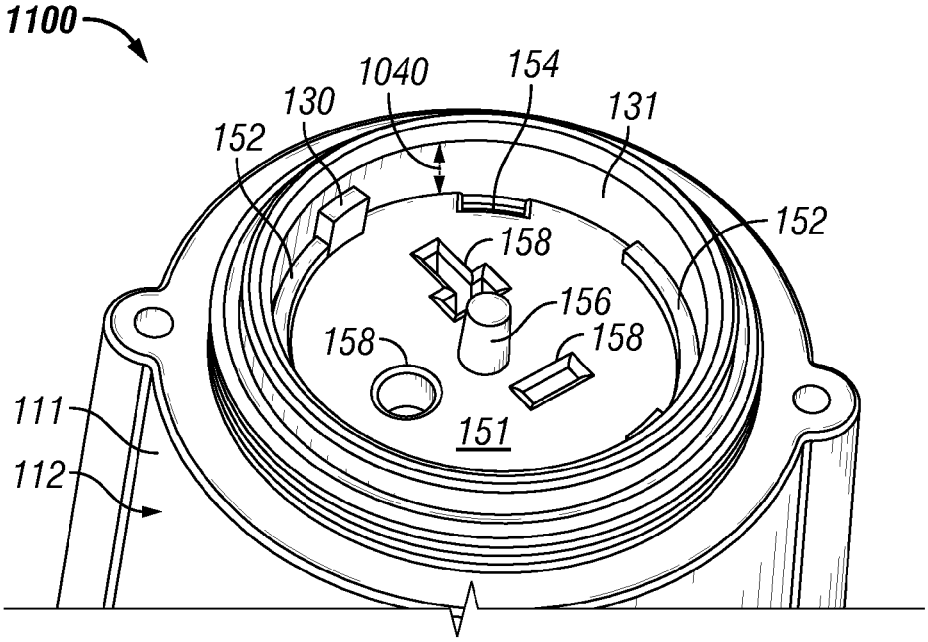
FIG. 11 shows various views of a portion of the electrical receptacle with the faceplate out of the "home" position in accordance with certain example embodiments.

FIGS. 9A-11 show various positions of the faceplate 150 relative to the outer body 220 using example embodiments. FIGS. 9A and 9B show the faceplate 150 of the electrical receptacle 100 in the "home" position 900 (corresponding with when the locking features 158 are aligned with the locking keys 130) in accordance with certain example embodiments. FIGS. 10A-10C show various views of the faceplate 150 of the electrical receptacle 100 in a transitional position 1000 (in this case, with the driving features 670 about halfway up the ramps 731) outside of the "home" position 900 in accordance with certain example embodiments. FIG. 11 shows various views of the faceplate 150 of the electrical receptacle 100 in another transitional position 1100 (in this case, with the driving features 670 all the way up the ramps 731) outside of the "home" position 900 in accordance with certain example embodiments.

Referring to FIGS. 1A-11, when the faceplate 150 is in the "home" position 900, the locking keys 130 of the housing 110 are disposed in the locking key receivers 154 of the faceplate. The upward (or outward) force applied by the compressive member 801 ensures that, when the compressive member 801 is in a normal state, the faceplate 150 is secured in the "home" position 900. When the faceplate 150 is in the "home" position 900, there is a distance 940 between the top surface 151 of the faceplate 150 and the upper lip 128 of the housing 110.

In addition, when the faceplate 150 is in the "home" position 900, the terminal receivers 158 that traverse the faceplate 150 are vertically aligned with the terminal receivers 221 of the upper body 220. Thus, is a user attempts to insert the properly configured electrical plug into the terminal receivers 158 of the faceplate 150, and simultaneously applies an inward force on the faceplate 150 sufficient to overcome the compressive force of the compressive member 801, there would be a mechanical coupling between the terminals of the electrical plug and the pin assemblies 224 of the terminal receivers 221 of the upper body 220.

In the "home" position 900, with a sufficient inward force applied to the faceplate 150, the driving features 670 are disposed within the receiving slots 732 of the driven features 230. Once this occurs, a sufficiently strong inward force must be applied to keep the driving features 670 disposed within the receiving slots 732. Alternatively, the driving features 670 and/or the receiving slots 732 can include one or more features (e.g., detents) that allow the driving features 670 to remain disposed within the receiving slots 732 without the need of maintaining a sufficient inward force on the faceplate 150. In such a case, an outward force, greater than the compressive force of the compression element 801 and sufficient to overcome the features of the driving features 670 and/or the receiving slots 732, can be applied to the faceplate 150 to remove the driving features 670 from the receiving slots 732.

Because of the way that the pin assemblies 224 are configured, the pin assemblies 224 can secure the terminals of the electrical plug with sufficient force as to overcome the compressive force of the compressive member 801 and maintain the mechanical coupling with the terminals of the electrical plug. In any case, once the terminals are mechanically coupled to the pin assemblies 224, electricity is not flowing through the electrical receptacle 100. For this to occur, the extensions 225 of the terminal receivers 221 must be rotated to contact electrically conductive elements within an inner portion of the electrical receptacle 100. In certain example embodiments, the outer body 220 is said to be in a disengaged position when the extensions 225 are not in contact with the electrically conductive elements within the inner portion of the electrical receptacle 100. Conversely, the outer body is in an engaged position when the extensions 225 are in contact (create an electric circuit) with the electrically conductive elements within the inner portion of the electrical receptacle 100.

A number of different configurations of the electrically conductive elements of the inner portion of the electrical receptacle 100 are possible. Examples of some of these configurations of the lower portion of the electrical receptacle and how the extensions 225 can mechanically and electrically couple to the lower portion, completing a circuit and allowing power to flow, can be found in the U.S. patent application titled "Contact Mechanisms For Electrical Receptacle Assemblies," as referenced and incorporated by reference above with respect to the first paragraph of this specification.

In simple terms, once the faceplate 150 is moved to and maintained in the "home" position 900, with a sufficient inward force applied so that the driving featrures 670 are disposed within the receiving slots 732, a user can rotate the plug in a certain direction (e.g., clockwise) while continuing to apply a sufficient inward force to the faceplate 150. The direction of this rotational force, as used here, can be opposite from the direction that the faceplate 150 is rotated to move the faceplate 150 to the "home" position 900, as when the driving features 670 are positioned on the ramps 731. When this rotational and inward force is applied to the electrical plug when the faceplate 150 is in the "home" position 900, the entire assembly of the electrical plug, the faceplate 150, and the outer body 220 move rotationally together.

The outer body 220 moves along the path allowed by the mechanical coupling with the inner surface 113 of the wall 112 of the housing 110. For example, as in this case, the mating threads disposed on the inner surface 113 of the wall 112 of the housing 110 and the outer surface 229 of the outer body 220 allows the extensions 225 to move in a path toward electrically conductive elements, allowing the electric circuit to be complete when the extensions 225 contact the conductive elements. When the electric circuit is complete, power flows through the extensions 225 and the pin assemblies 224 of the terminal receivers 221 of the outer body 220 and through the termanals of the plug, as shown below with respect to FIGS. 13A-13C.

FIGS. 10A-10C show various views of the faceplate 150 in a transitional position 1000 (in this case, with the driving features 670 about halfway up the ramps 731) outside of the "home" position 900. For the faceplate 150 to move, the terminals of a properly configured electrical plug (not shown to more clearly show the receptacle) are inserted into the terminal receivers 158 of the faceplate 150. By using the proper electrical plug, the terminals of the electrical plug can be disposed in the terminal receivers 158 of the faceplate 150. At that point, a user can apply a rotational force so that the locking key receivers 154 approach and eventually receive the locking keys 130. Once the locking keys 130 are disposed in the locking key receivers 154, the faceplate is in the "home" position 900, and the steps noted above with respect to FIGS. 9A and 9B can be taken.

In any case, once the faceplate 150 is in out of the "home" position 900, the distance 1040 between the top surface 151 of the faceplate 150 and the upper lip 128 of the housing 110 is greater than the distance 940 between the top surface 151 of the faceplate 150 and the upper lip 128 of the housing 110 when the faceplate 150 is in the "home position 900. Further, once the faceplate is in the "home" position 900, as an inward force is applied to the faceplate 150 so that the driving features 670 become seated in the receiving slots 732, the distance between the top surface 151 of the faceplate 150 and the upper lip 128 of the housing 110 is greater than distance 1040 or distance 940. At this point, the terminals of the electrical plug become inserted into the terminal receivers 221 of the outer body 221 such that the terminals of the electrical plug become mechanically coupled to the pin assemblies 224.

In certain example embodiments, a locking device (not shown) can be used to prevent a user from removing and/or replacing the faceplate 150. The locking device can be used as an extra measure of safety and security. Specifically, when the faceplate 150 is changed, different electrical plugs are required. In addition, or in the alternative, different ratings of voltage and/or amperage can apply based on the electrical plug in use. A manufacturer and/or other entity may use a locking device to help prevent the electrical receptacle 100 from being unsafely used for something other than its intended, safe application.

Such a locking device can be mechanically coupled to one or more components (e.g., the housing 110, the outer body 220) of the electrical receptacle 100. The locking device can have one or more of a number of forms, including but not limited to a fastening device, a rivet, a compression fitting, and a weld.

Figure 12:
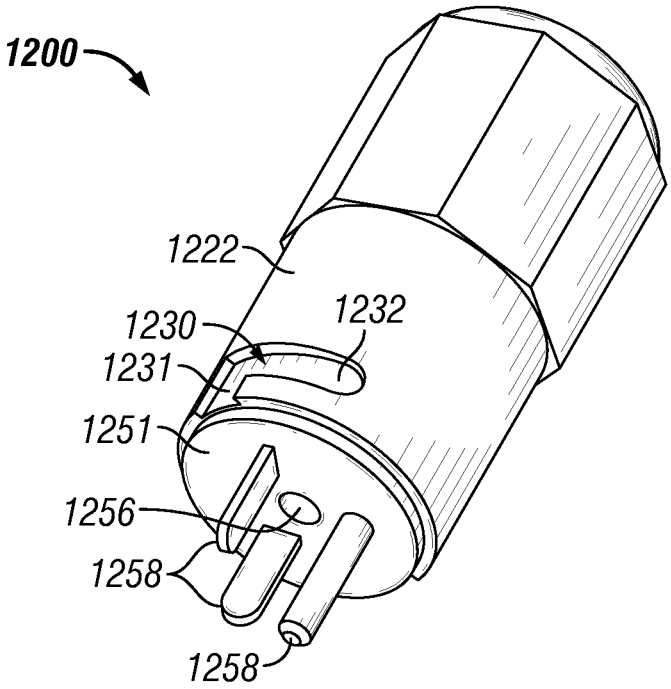
FIG. 12 shows a perspective view of an electrical plug in accordance with certain example embodiments.

FIG. 12 shows a perspective view of a plug 1200 in accordance with certain example embodiments. In one or more example embodiments, one or more of the components shown in FIG. 12 may be omitted, repeated, and/or substituted. Accordingly, example embodiments of a plug (or portions thereof) should not be considered limited to the specific arrangements of components shown in FIG. 12.

Referring to FIGS. 1A-12, the plug 1200 (also called an electrical plug 1200) can include a plug body 1222. The plug body 1222 can have a shape and size that allows at least a portion of the distal end to be disposed within the cavity 119 of the housing 110 to allow for coupling between the plug 1200 and the receptacle 100. In this case, the cross-sectional shape of the plug body 1222 is circular, which matches the cross-sectional shape of the cavity 119 of the housing 100.

Disposed on the end surface 1251 at the distal end of the plug body 1222 are a number (in this case, three) of terminals 1258 that extend outward from the end surface 1251. The terminals are made of one or more of a number of electrically conductive materials, including but not limited to copper and aluminum. The shape, size, orientation, and positioning of the terminals 1258 are configured to be substantially complementary to the shape, size, orientation, and positioning of the terminal receivers 156 on the faceplate 150. This, in conjunction with the shape, size, orientation, and positioning of the rejection feature receiver 1256 with respect to the rejection feature 156 (described below), allows the plug 1200 to be mechanically and electrically coupled to the receptacle 100. If the shape, size, orientation, and positioning of the terminals 1258 are not substantially complementary to the shape, size, orientation, and positioning of the terminal receivers 156 on the faceplate 150, then the plug 1200 cannot be mechanically and electrically coupled to the receptacle 100.

Also disposed on the end surface 1251 at the distal end of the plug body 1222 is one or more of a number of rejection feature receivers 1256. In this case, there is one rejection feature receiver 1256 that is a recess extending inward from the end surface 1251. The shape, size, orientation, and positioning of the rejection feature receiver 1256 is configured to be substantially complementary to the shape, size, orientation, and positioning of the rejection feature 156 on the faceplate 150. This, in conjunction with the shape, size, orientation, and positioning of the terminals 1258 with respect to the terminal receivers 158, allows the plug 1200 to be mechanically and electrically coupled to the receptacle 100. If the shape, size, orientation, and positioning of the rejection feature receiver 1256 is not substantially complementary to the shape, size, orientation, and positioning of the rejection feature 156 on the faceplate 150, then the plug 1200 cannot be mechanically and electrically coupled to the receptacle 100.

In addition, disposed along the side of the plug body 1222 at the distal end is at least one locking slot 1230. Each locking slot 1230 is configured to receive a locking key 130 disposed on the inner surface 131 of the wall 112 of the housing 110. The locking slot 1230 can have a shape that allows for an electrical connection between the extensions 225 of the outer body 220 and electrically conductive elements further into the receptacle 110 or inside of an enclosure to which the receptacle 110 is mechanically coupled. Specifically, the shape of each locking slot 1230 mimics the path of the faceplate 150 described above.

Each locking slot 1230 can have one or more portions. For example, as shown in FIG. 12, the locking slot 1230 starts with a radial portion 1231 that extends away from the end surface 1251, followed by a lateral portion 1232. There can be at least as many locking slots 1230 as there are locking keys 130. The shape, size, orientation, and positioning of the locking slots 1230 is configured to be substantially complementary to the shape, size, orientation, and positioning of the locking keys 130, as well as the path followed by the faceplate 150 to create an electrical connection through the electrical receptacle 100.

Figure 13A:
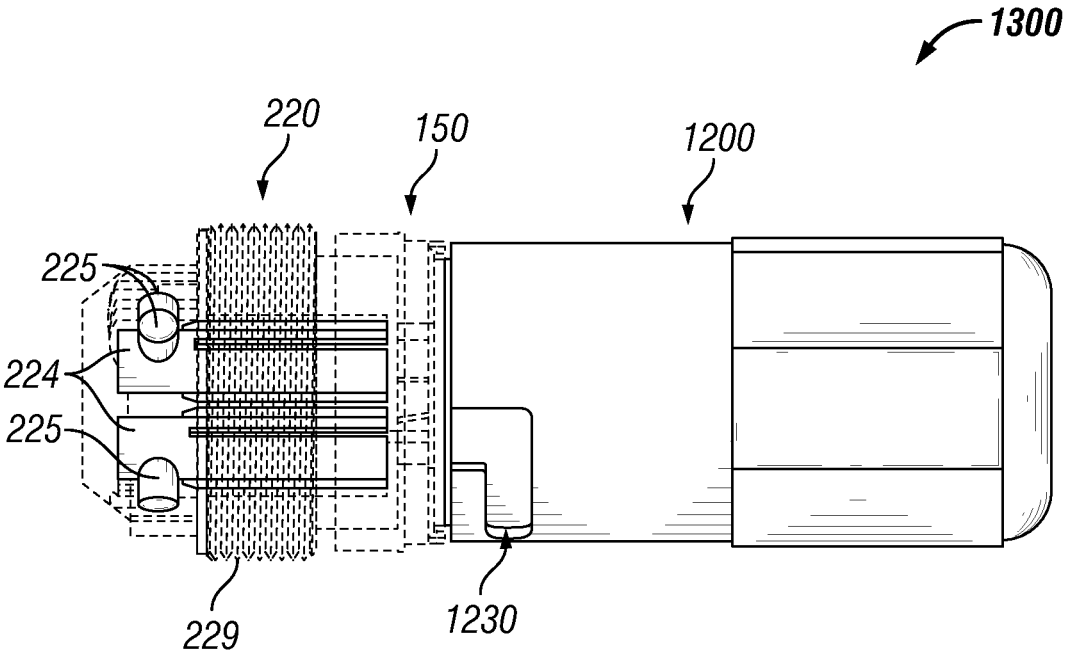
FIGS. 13A-13C show various views of a plug and a portion of the electrical receptacle in accordance with certain example embodiments.
Figure 13B:
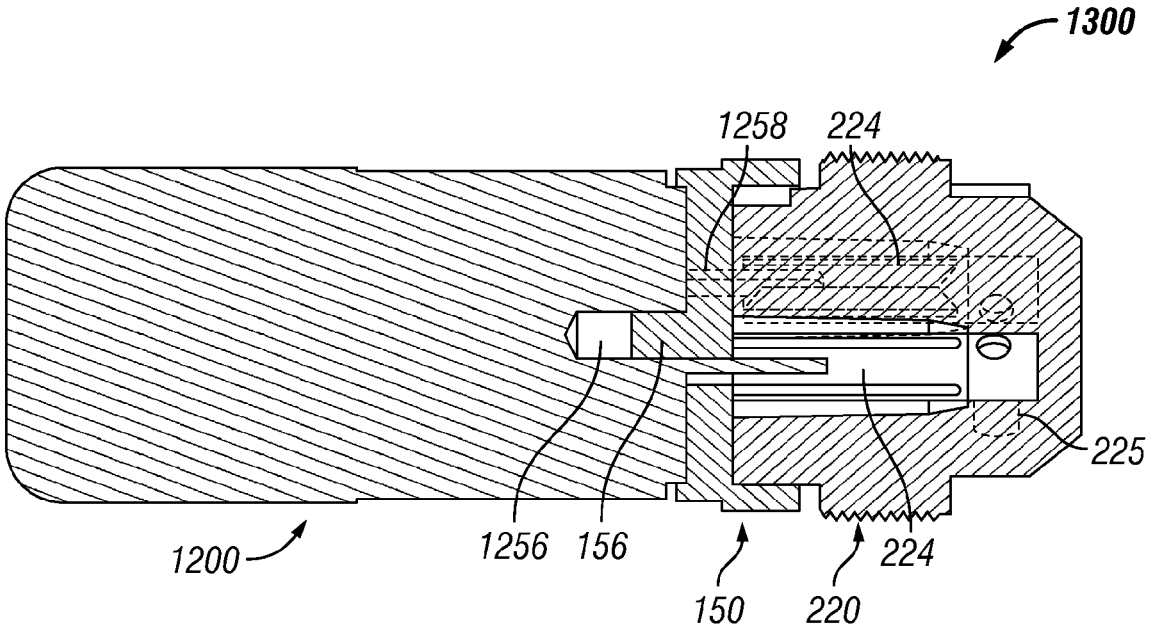
Figure 13C:
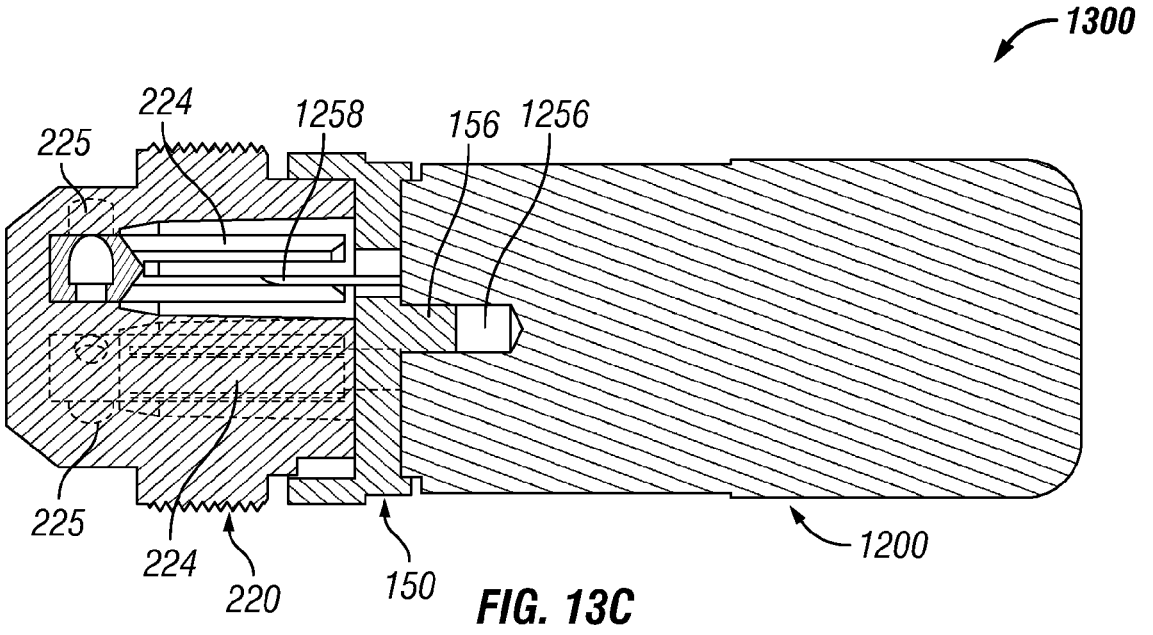

FIGS. 13A-13C show various views of an electrical receptacle subassembly that includes the plug 1200, the faceplate 150, and the outer body 220 in accordance with certain example embodiments. Specifically, FIG. 13A shows a side view of the subassembly 1300 with the outer body 220 and the faceplate 150 in transparency. FIGS. 13B and 13C each show different cross-sectional side views of the subassembly 1300 with the outer body 220 and the faceplate 150 in transparency. In one or more example embodiments, one or more of the components shown in FIGS. 13A-13C may be omitted, repeated, and/or substituted. Accordingly, example embodiments of a plug and electrical receptacle (or portions thereof) should not be considered limited to the specific arrangements of components shown in FIGS. 13A-13C.

Referring to FIGS. 1A-13C, FIGS. 13A-13C show how the rejection feature 156 of the faceplate 150 is disposed within the rejection feature receiver 1256 of the plug 1200 when the terminals 1256 of the plug 1200 are engaged with the terminal receivers 156 of the faceplate 150 and with the pin assemblies 224 of the outer body 220. FIGS. 13A-13C also show how each of the terminals 1256 of the plug 1200 are disposed within each of the pin assemblies 224 of the terminal receivers 221 of the outer body 220.

In one or more example embodiments, example lockout features for electrical receptacle assemblies described herein allow a plug and an electrical receptacle to be mechanically and electrically coupled to each other safely and securely. The example lockout features require specific equipment (e.g., the properly configured plug and the properly configured electrical receptacle) and specific movement of that equipment to achieve an electrical and mechanical coupling. Further, example lockout features comply with one or more of a number of standards and/or regulations for electrical connectors. Such standards and/or regulations can be related to hazardous enclosures, hazardous locations, and explosion-proof enclosures.

Accordingly, many modifications and other embodiments set forth herein will come to mind to one skilled in the art to which lockout features for electrical receptacle assemblies pertain having the benefit of the teachings presented in the foregoing descriptions and the associated drawings. Therefore, it is to be understood that lockout features for electrical receptacle assemblies are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. An electrical receptacle assembly, comprising:

an outer body comprising at least one driven feature disposed on an outer surface of the outer body and a plurality of pin assemblies disposed within the outer body, wherein the plurality of pin assemblies is configured to receive a plurality of terminals of an electrical plug; and a faceplate comprising a plurality of terminal receivers and at least one driving feature, wherein the plurality of terminal receivers traverses the faceplate and is configured to receive the plurality of terminals of the electrical plug, and wherein the at least one driving feature is disposed on a surface of the faceplate, wherein the faceplate is configured to rotate relative to the outer body, wherein the at least one driving feature of the faceplate couples to the at least one driven feature of the outer body when the faceplate is in a home position and when an inward force is applied by the electrical plug when the plurality of terminals of the electrical plug are disposed through the plurality of terminal receivers of the faceplate.

2. The electrical receptacle assembly of claim 1, wherein the electrical plug comprises a first configuration of the plurality of terminals that uniquely correspond to a second configuration of the plurality of terminal receivers of the faceplate.

3. The electrical receptacle assembly of claim 1, further comprising:

a housing comprising at least one wall that forms a cavity and at least one locking key disposed on an inner surface of the at least one wall, wherein the faceplate further comprises at least one locking key receiver disposed on the top side of the faceplate, wherein at least one locking key is disposed in the at least one locking key receiver when the faceplate is in the home position.

4. The electrical receptacle assembly of claim 3, wherein the outer body is moved from a disengaged position to an engaged position when the electrical plug applies a rotational force to the faceplate while the faceplate is in the home position and when the at least one driving feature is disposed within the at least one receiving slot of the at least one driven feature.

5. An electrical receptacle assembly, comprising:

an outer body comprising at least one driven feature disposed on an outer surface of the outer body and a plurality of pin assemblies disposed within the outer body, wherein the plurality of pin assemblies is configured to receive a plurality of terminals of an electrical plug; and a faceplate comprising a plurality of terminal receivers and at least one driving feature, wherein the plurality of terminal receivers traverses the faceplate and is configured to receive the plurality of terminals of the electrical plug, and wherein the at least one driving feature is disposed on a surface of the faceplate, wherein the at least one driving feature of the faceplate couples to at least one ramp of the at least one driven feature of the outer body when the faceplate is out of a home position, and wherein the faceplate is configured to rotate to the home position using the electrical plug when the plurality of terminals is disposed in the plurality of terminal receivers.

6. The electrical receptacle assembly of claim 5, further comprising:

a compressive member disposed between the faceplate and the outer body, wherein the compressive member has a natural state and a compressed state, wherein the compressive member is in the compressed state when an inward force applied by the electrical plug is greater than a compressive force of the compressive member, and wherein the compressive member is in the compressed state when the at least one driving feature of the faceplate is disposed within at least one receiving slot of the at least one driven feature of the outer body.

7. The electrical receptacle assembly of claim 6, wherein the compressive member is disposed over a portion of the outer body and abuts against a bottom end of the faceplate.

8. The electrical receptacle assembly of claim 7, further comprising:

a housing comprising at least one wall that forms a cavity and at least one locking key disposed on an inner surface of the at least one wall, wherein the faceplate further comprises at least one locking key receiver disposed on the top side of the faceplate, and wherein at least one locking key is disposed in the at least one locking key receiver when the faceplate is in the home position.

9. The electrical receptacle assembly of claim 8, wherein the faceplate is moved toward the home position when the electrical plug applies a first rotational force to the faceplate.

10. The electrical receptacle assembly of claim 9, wherein the outer body is moved from a disengaged position to an engaged position when the electrical plug applies a second rotational force to the faceplate while the faceplate is in the home position and when the at least one driven feature is disposed within the at least one receiving slot of the at least one driving feature.

11. The electrical receptacle assembly of claim 10, wherein the first rotational force is counter-clockwise, and wherein the second rotational force is clockwise.

12. The electrical receptacle assembly of claim 10, wherein the outer body further comprises a first coupling feature disposed on the outer surface, wherein the housing further comprises a second coupling feature disposed on the inner surface of the at least one wall, wherein the second coupling feature complements the first coupling feature, and wherein the first coupling feature and the second coupling feature guide the outer body from the disengaged position to the engaged position when the second rotational force is applied to the faceplate.

13. The electrical receptacle assembly of claim 12, wherein the second coupling feature terminates within a height of the outer body.

14. The electrical receptacle assembly of claim 8, wherein the faceplate further comprises at least one lug disposed on a top side of the faceplate, wherein the at least one locking key abuts the at least one lug when the faceplate is rotated away from the home position.

15. The electrical receptacle assembly of claim 8, further comprising:

a locking device mechanically coupled to the housing, wherein the locking device prevents a user from removing the faceplate.

16. The electrical receptacle assembly of claim 8, wherein the at least one locking key retains the faceplate within the cavity of the housing.

17. The electrical receptacle assembly of claim 5, wherein the electrical plug comprises a first configuration of the plurality of terminals based on the plurality of terminal receivers of the faceplate, wherein a different electrical plug comprising a second configuration of the plurality of terminals is unable to rotate the faceplate to the second position, wherein the second configuration is different from the first configuration.

18. The electrical receptacle assembly of claim 17, wherein the faceplate further comprises at least one rejection feature to ensure that the different electrical plug is unable to rotate the faceplate.

19. The electrical receptacle assembly of claim 5, wherein the plurality of terminals of the electrical plug electrically and mechanically couples to a plurality of pin assemblies disposed within the outer body when the faceplate is in the second position, wherein the plurality of terminals of the electrical plug are electrically and mechanically decoupled from the plurality of pin assemblies disposed within the outer body when the faceplate is in the first position.

* * * * *